US005470238A

United States Patent [19]

Walden

[11] Patent Number: 5,470,238

[45] Date of Patent: Nov. 28, 1995

[54] SHIELDED RIBBON CABLE ELECTRICAL CONNECTOR ASSEMBLY AND METHOD

[75] Inventor: John D. Walden, Mechanicsburg, Pa.

[73] Assignee: Intercon Systems, Inc., Harrisburg, Pa.

[21] Appl. No.: 193,795

[22] Filed: Feb. 9, 1994

[51] Int. Cl.[6] ..... H01R 13/58; H01R 13/652

[52] U.S. Cl. ..... 439/98; 439/108; 439/497; 439/606; 439/607

[58] Field of Search ..... 439/98, 108, 497, 439/607, 606

[56] References Cited

U.S. PATENT DOCUMENTS

| | | | |
|---|---|---|---|
| Re. 27,743 | 8/1973 | Weimer, Jr. | 174/94 |
| 3,138,658 | 6/1964 | Weimer, Jr. | 174/94 |
| 3,249,909 | 5/1966 | Kowalewski | 439/606 |
| 3,504,101 | 3/1970 | Muto | 174/94 |
| 3,541,226 | 11/1970 | Cea et al. | 174/84 |
| 3,541,227 | 11/1970 | Bendrick | 174/94 |
| 3,715,423 | 2/1973 | Dunn | 264/250 |
| 3,740,698 | 6/1973 | Jerominek | 339/17 |
| 4,235,832 | 11/1980 | Leighton | 264/230 |
| 4,323,295 | 4/1982 | Davis, Jr. | 339/107 |
| 4,352,531 | 10/1982 | Gutter | 339/14 |
| 4,408,823 | 10/1983 | Huber | 439/497 |
| 4,420,201 | 12/1983 | Stephenson | 339/14 |
| 4,536,053 | 8/1985 | Maros | 339/143 |
| 4,544,227 | 10/1985 | Hirose | 339/143 |
| 4,582,384 | 4/1986 | Frantz et al. | 339/143 |
| 4,596,428 | 6/1986 | Tengler | 339/14 |
| 4,601,527 | 7/1986 | Lemke | 339/14 |
| 4,619,487 | 10/1986 | Brush, Jr. | 339/14 |
| 4,639,053 | 1/1987 | Reichardt et al. | 339/14 |
| 4,655,518 | 4/1987 | Johnson et al. | 339/17 |
| 4,687,263 | 8/1987 | Cosmos et al. | 439/108 |
| 4,758,179 | 7/1988 | Klein et al. | 439/497 |
| 4,773,878 | 9/1988 | Hansell, III | 439/497 |
| 4,793,060 | 12/1988 | Pretchel | 29/858 |
| 4,803,030 | 2/1989 | Kobayashi | 264/278 |
| 4,808,115 | 2/1989 | Norton et al. | 439/79 |
| 4,822,304 | 4/1989 | Herron | 439/610 |
| 4,824,384 | 4/1989 | Nicholas et al. | 439/108 |
| 4,888,307 | 12/1989 | Spairisano et al. | 437/216 |
| 4,892,489 | 1/1990 | Hirai | 439/497 |
| 4,971,574 | 11/1990 | Garcia | 439/497 |
| 4,973,264 | 11/1990 | Kamano et al. | 439/498 |
| 4,985,000 | 1/1991 | Tengler et al. | 439/497 |
| 5,032,089 | 7/1991 | Hansell, II | 439/609 |
| 5,059,746 | 10/1991 | Hayes et al. | 174/52.1 |
| 5,066,236 | 11/1991 | Broeksteeg | 439/79 |
| 5,071,611 | 12/1991 | Yagi et al. | 264/154 |
| 5,104,329 | 4/1992 | Brown et al. | 439/108 |
| 5,116,239 | 5/1992 | Siwinski | 439/497 |
| 5,135,405 | 8/1992 | Fusselman et al. | 439/108 |
| 5,137,472 | 8/1992 | Hillbish et al. | 439/607 |
| 5,174,771 | 12/1992 | Burgit et al. | 439/108 E |
| 5,176,526 | 1/1993 | Hillbish et al. | 439/108 |
| 5,228,864 | 7/1993 | Fusselman et al. | 439/108 |
| 5,238,428 | 8/1993 | Brakenridge et al. | 439/610 |
| 5,259,772 | 11/1993 | Fusselman et al. | 439/108 |
| 5,259,773 | 11/1993 | Champion et al. | 439/108 |

FOREIGN PATENT DOCUMENTS

| | | |
|---|---|---|
| 2117074 | 5/1990 | Japan . |
| 2121618 | 12/1983 | United Kingdom . |
| 2160719 | 12/1985 | United Kingdom . |

*Primary Examiner*—Kenneth J. Ramsey
*Attorney, Agent, or Firm*—Thomas Hooker

[57] ABSTRACT

A shielded ribbon cable electrical connector assembly includes a shielded cable connector with an overmolded body mounted on the end of the shielded cable and a shielded pin header adapted to be mounted on a circuit board and to mate with the connector. The connector includes a cable clamp on the end of the cable, a premolded connector block containing a row of disconnect terminals and a circuit board forming electrical connections between conductors in the cable and terminals in the connector block. A ground shield plate overlies the circuit board and includes a contact tongue which extends into the cable clamp and is held against the cable shield and a contact finger which overlies the connector block and forms a ground connection with a ground shield on the header. An overmolded plastic body surrounds the cable clamp, circuit board, connector ground shield and part of the connector block.

31 Claims, 6 Drawing Sheets

FIG.6
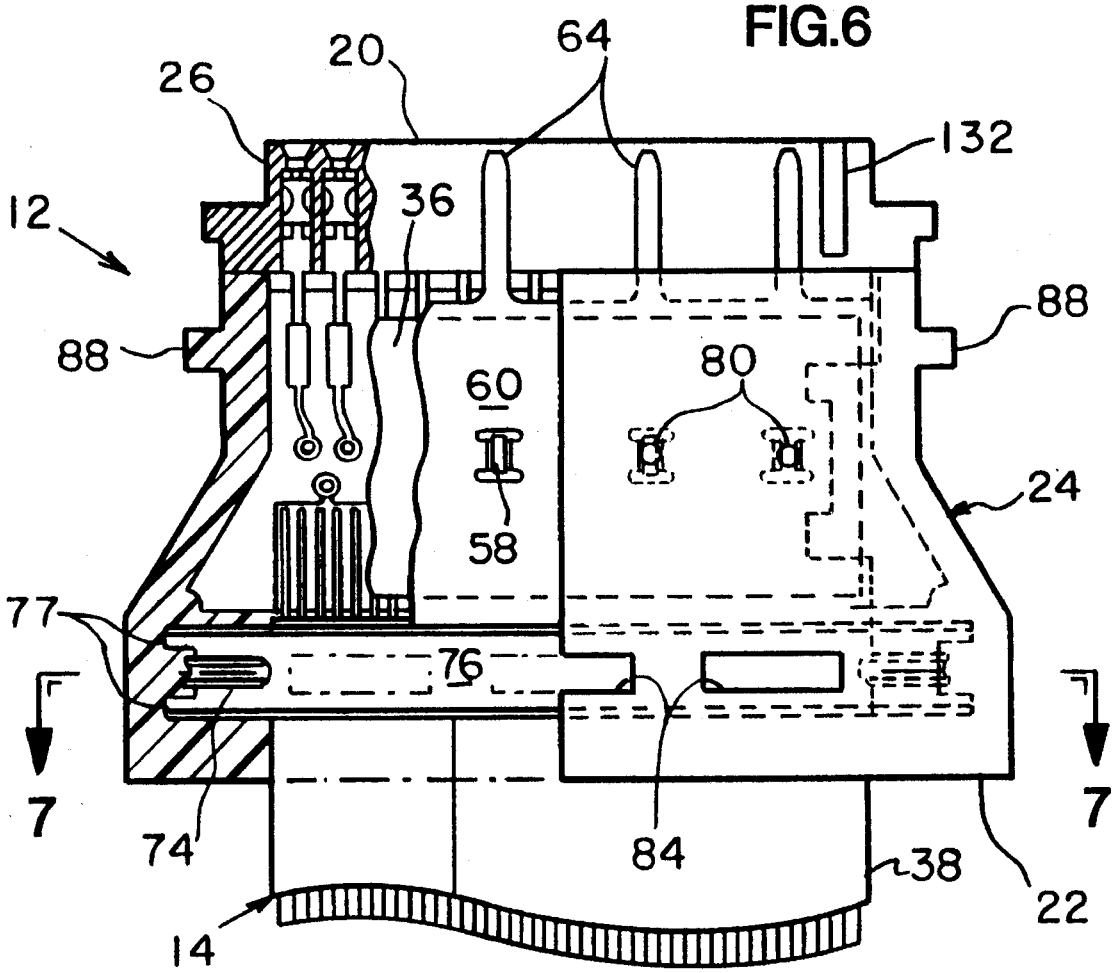
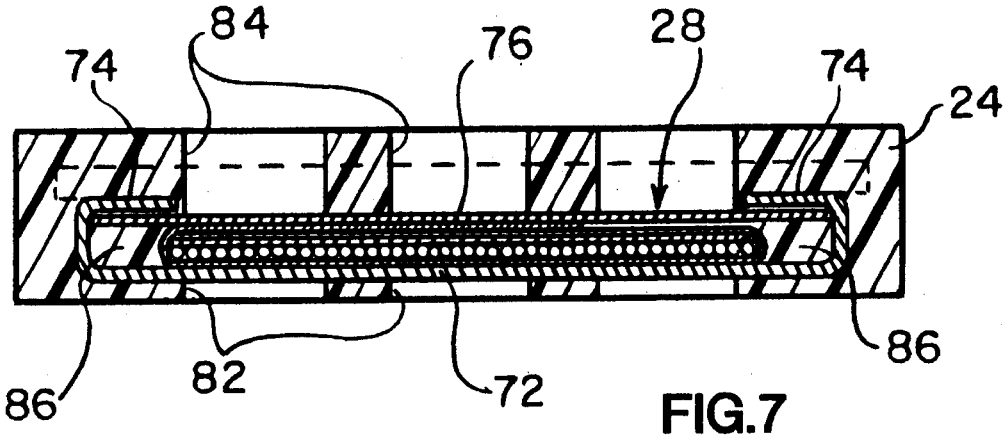
FIG.7

SHIELDED RIBBON CABLE ELECTRICAL CONNECTOR ASSEMBLY AND METHOD

FIELD OF THE INVENTION

The invention relates to a shielded electrical connector assembly for connecting a ribbon cable to a circuit board and to a method for making a shielded ribbon cable connector used in the assembly.

DESCRIPTION OF THE PRIOR ART

Ribbon cables are used in electronic systems to link system components. Electrical connectors on the ends of flat ribbon cables and on printed circuit boards are mated to permit communication of signals within the system. Signals containing large amounts of data are rapidly transmitted through the ribbon cable and the electrical connector assemblies joining the cable to system components.

External interference signals including noise and stray signals from adjacent equipment interfere with and degrade the signals transmitted through the cables and connectors. In an attempt to avoid signal degradation, ribbon cables and electrical connectors for ribbon cables are shielded to block interference. Metallized mylar film shields are wrapped around ribbon cables. Connector shields partially or totally enclose the components in the connectors. Conventional cable connectors are provided with contacts which form ground connections between the connector shield and the member mating with the connector, typically a pin header receptacle soldered on a printed circuit board. The connector shield may be enclosed in an overmolded connector body.

Problems are encountered in the manufacture of shielded overmolded ribbon cable connectors. During the overmolding process, the shielded connector subassembly is held in place in a mold cavity by mold tooling. Molten plastic is injected into the mold cavity and flows under high pressure around the shielded connector subassembly. The pressurized plastic may break ground wires used to form ground connections with the cable shield. A broken wire may move in the mold and form an undesired connection with a signal or logic ground conductor of the connector. The injected pressurized plastic may flow under the mylar shield and into the cable, distort or tear the mylar shield and break the ground connection with the shield. The free end of the mylar shield may be displaced in the mold.

SUMMARY OF THE INVENTION

The invention is a shielded ribbon cable electrical connector assembly with an overmolded ribbon cable connector and a method for making the connector using overmolding.

The electrical connector is molded on the end of a flat ribbon cable having conductors surrounded by a flexible metallized mylar shield. The connector has a ground shield with an essentially flat main shield portion, contact fingers spaced along a first edge of the flat shield portion and a contact tongue on an opposed edge below the flat shield portion having a curved channel section. The channel section of the tongue is inserted between the mylar shield and the cable to form a ground connection extending across the width of the cable. A rigid cable clamp surrounds the cable and tongue and clamps the mylar against the tongue to establish the ground connections and form a U-bend strain relief ground connection. Overmolding forms a rigid plastic body surrounding the shield and the cable clamp to maintain the ground connection with the cable shield. The fingers on the ground shield are exposed on the front of the connector to form ground connections with contact arms on the ground shield of a header receptacle mating with the connector. The cable clamp sandwiches the mylar shield against the ribbon cable conductors and prevents movement of the mylar film or flowing of plastic into the cable between the shield and the conductors.

Other objects and features of the invention will become apparent as the description proceeds, especially when taken in conjunction with the accompanying drawings illustrating the invention, of which there are six sheets and one embodiment.

DESCRIPTION OF THE DRAWINGS

FIG. 6 is a top view, partially broken away, of the connector shown in FIG. 1; and FIG. 7 is a sectional view taken along line 7—7 of FIG. 6.

DESCRIPTION OF THE PREFERRED EMBODIMENT

Figure 1:
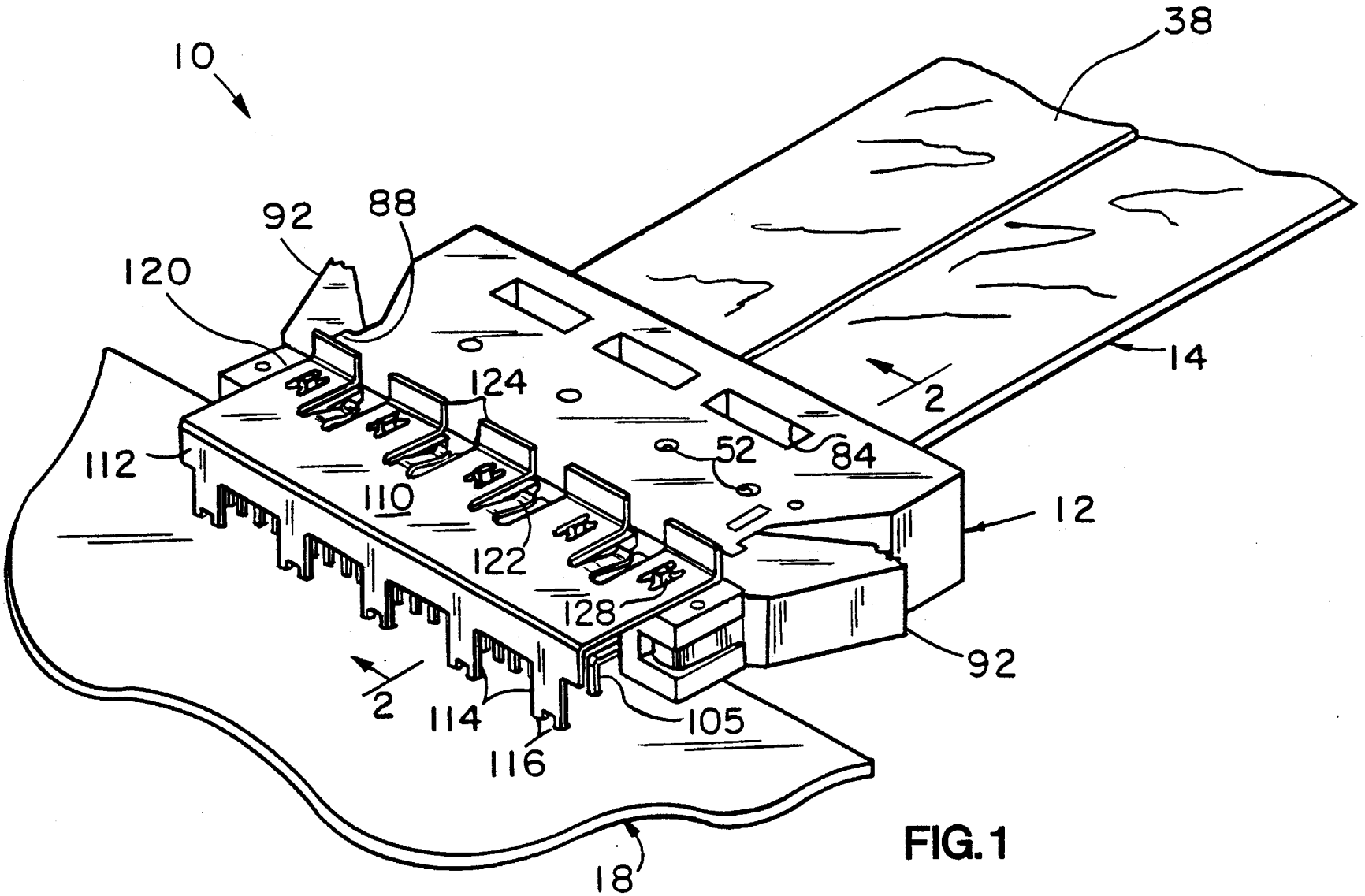
FIG. 1 is an isometric view of a shielded connector assembly with a ribbon cable connector mated with a receptacle.

Shielded electrical connector assembly 10 includes a shielded ribbon cable connector 12 molded on one end of shielded ribbon cable 14. The connector mateably engages shielded pin header receptacle 16 mounted on circuit board 18.

The cable connector 12 extends along the width of cable 14 and includes a front face 20 adjacent pin header receptacle 16 and a rear face 22 facing away from the pin header receptacle. Overmolded plastic body 24 extends from the rear face 22 toward the front face 20 and surrounds the rear portion of premolded two row connector block 26 which defines the front face 20.

Figure 2:
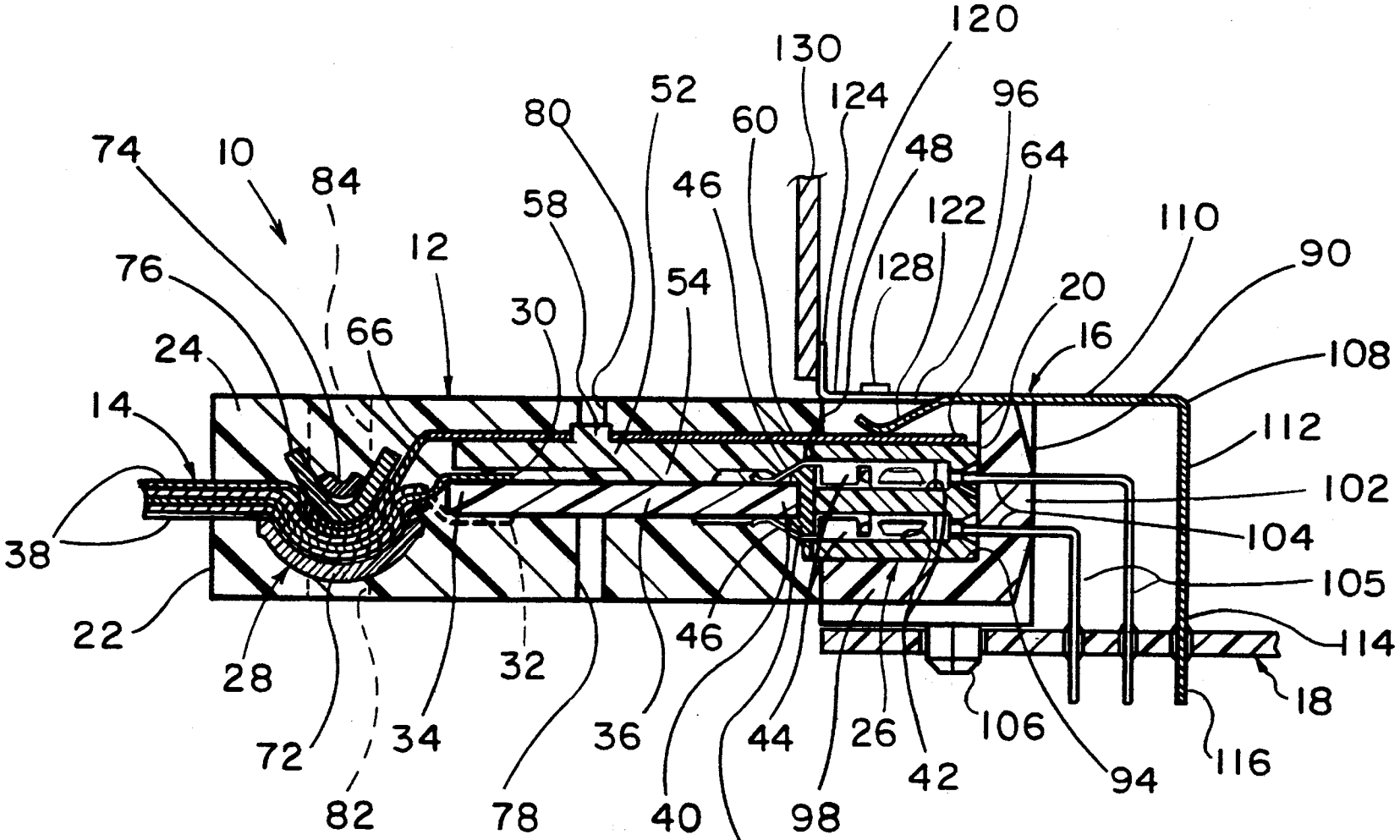
FIG. 2 is a sectional view taken along line 2—2 of FIG. 1.

Cable 14 extends into the rear face of body 24 and is engaged by cable clamp 28 molded within body 24. The cable is of conventional design and includes a plurality of spaced insulated signal conductors 30 separated from each other by a plurality of logic ground conductors 32. As shown in FIG. 2, the ends of signal conductors 30 extending outwardly of the cable clamp 28 are bonded to contact pads extending along the top of a programming circuit board 36 embedded within body 24 at rear board edge 34. The ends of the logic ground conductors 32 in cable 14 are bent down and are bonded to contact pads on the lower surface of programming circuit board 36 at board edge 34.

Figure 3:
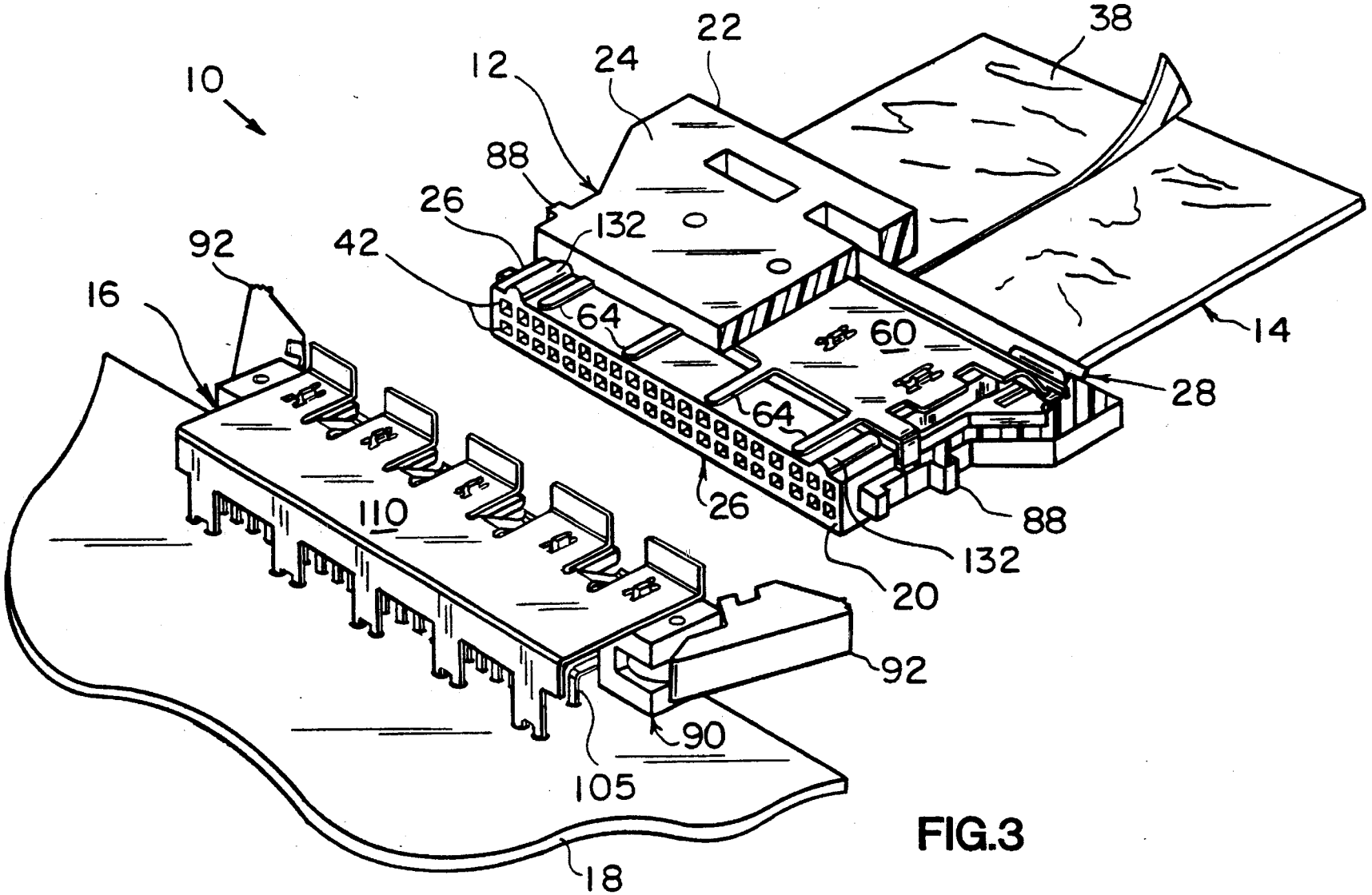
FIG. 3 is an isometric view with the connector and receptacle of FIG. 1 disconnected and with a portion of the connector broken away.

Cable 14 is ground shielded against external interference signals by a thin mylar film 38 which is wrapped around the length of the cable with overlapping edges bonded together at the middle of the cable as shown in FIG. 3. The inner surface of the mylar film 38 has a metallized coating, which may be made of aluminum, to provide a continuous circumferential ground shield surrounding both the signal and logic ground conductors in the cable. The mylar shield extends through the cable clamp 28. The clamp holds the ends of the mylar tightly against the cable during overmolding of body 24 and prevents molten plastic from flowing into the interior of the cable.

Two rows of contact pads are provided on either side of the front edge 40 of programming circuit board 36 located adjacent connector block 26. The circuit board includes circuit paths connecting the signal conductors 30 in cable 14 to the contact pads at front edge 40. The board also includes circuitry connecting the logic ground conductors 32 to one or more contact pads at the front edge 40.

Block 26 includes two rows of terminal cavities 42 extending along the length of the block and opening into the front face 20 as illustrated in FIG. 3. Female disconnect terminals 44 are fitted in cavities 42 and mate with pins of pin header receptacle 16 which are inserted into the cavities through the openings as shown in FIG. 2. Terminals 44 include contact tails 46 which extend from block 26 into the overmolded plastic body 24 and are connected to the contact pads on the top and bottom of front edge 40 of board 36. The overmolded body 24 surrounds and joins block 26 at rear face 48 so that the body and block form integral portions of the connector 12. Plug 50 overlies the rear face 48 of block 26 to prevent molten plastic from flowing into cavities 42 during overmolding.

The connector 12 includes a preformed plastic spacer plate 52 located above circuit board 36 and molded in body 24. The plate 52 includes a spacing ridge 54 extending along the length of the lower surface thereof. As shown in FIG. 2, ridge 54 rests on the top of board 36 and spaces plate 52 above the circuit board 36. Bevel 56 at the lower front edge of the plate rests on the terminal tails 46 extending outwardly from the top row of terminals in block 26. A plurality of spaced mounting posts 58 extend upwardly from the top of the plate. Tails 46 extend between the plug and the plate 52.

Ground plate 60 is stamp-formed from thin metal stock and is mounted on spacer plate 52 prior to overmolding of connector 12. The plate 60 is provided with a number of apertures 62 corresponding to posts 58 with each aperture defined by a pair of stiffly flexible arms adapted to engage a post and hold the ground plate on the spacer plate as shown in FIGS. 2 and 3 prior to overmolding. Plate 60 also includes a plurality of spaced contact fingers 64 extending from the front edge of the plate and overlying the top of block 26. A wide contact tongue 66 extends from the rear edge of the plate downwardly at an angle and includes a curved contact channel 68 on the free end thereof outwardly of the plate. The channel 68 is downwardly curved and opens upwardly. Shield side arms 70 are bent down from either side edge of the front of the plate 60 to aid in positioning the shield 60 on the printed circuit board 36.

When plate 60 is mounted on plate 52, and the assembly is positioned on top of board 36, surface 56 engages the upper contact tails 46 and ridge 54 rests on top of board 36. In this position, plate 52 is spaced above the board 36 and the contact fingers 64 rest on the top of block 26. The contact tongue 66 extends into the cable clamp 28 between the upper layer of mylar film 38 and the top of the cable signal and logic conductors 30 and 32 as illustrated in FIG. 2.

The cable clamp 28 is secured to the end of the cable connector 12 after the contact tongue 66 of plate 60 has been inserted in the end of the cable 14 between the upper layer of the mylar film 38 and the signal and logic conductors. The tongue contacts the metallized layer on the interior surface of the mylar film. The plates 52 and 60 are joined together and positioned on board 36 as illustrated in FIG. 2.

Figure 5:
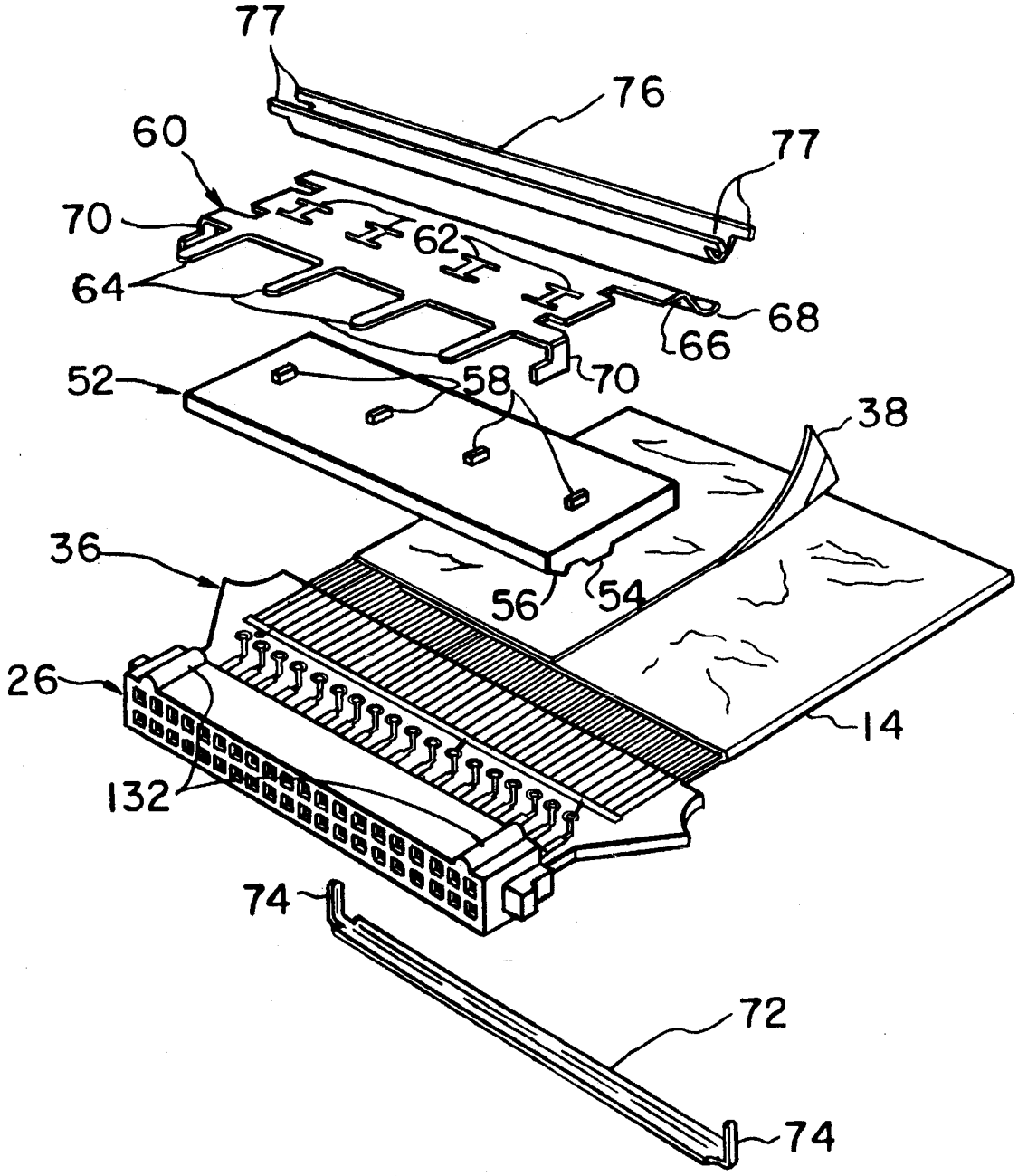
FIG. 5 is an exploded isometric view of the connector shown in FIG. 1.

As shown in FIG. 5, the cable clamp 28 includes a rigid lower channel-shaped clamp bar 72 having a length greater than the width of ribbon cable 14 and a pair of clamp arms 74 on the ends of the bar. The arms 74 extend upwardly at approximately 90 degrees to the length of the clamp bar prior to assembly of the cable clamp. Clamp 28 also includes a rigid upper channel-shaped clamp bar 76 having a length greater than the width of cable 14 and a pair of spaced ears 77 at opposite edges of each end of the bar. The channels in bars 72 and 76 are downwardly curved and open upwardly. The transverse radius of curvature of bar 76 is less than the transverse radius of curvature of bar 72, as shown in FIG. 2, to facilitate clamping of the cable end between the two bars. The surface of bar 72 which engages one side of the cable is concave and has a larger radius of curvature than the convex surface of bar 76 which engages the other side of the cable. The bars clamp the end of the cable in a U-bend to close the shield 38 against plastic during overmolding, hold the cable in the connector and secure a ground connection between the ground shield on film 38 and plate 60.

The channel-shaped bars are stiff and resist lateral flexing, resulting in tight clamping of the cable in the cable clamp across the full width of the cable.

With the end of contact tongue 66 extending between the cable conductors and the upper mylar shield surrounding the cable, the cable clamp is applied to the cable using suitable tooling holding bar 72 against the lower surface of the end of the cable and bar 76 tightly against the top of the cable to force the cable into a U-shaped bend between the two bars along the full width of the cable. With the two bars held tightly together by the tooling, additional tooling bends down the two clamp arms 74 into the recesses between ears 77 in the ends of upper bar 76, thereby securing the bars together with the cable end clamped between the two bars. The channel-shape of the bars provides a tight cable clamp connection which forms a ground connection between the metallized film and shield 60 along the length of the clamp and acts as a strain relief for securing the cable in the connector 12 after overmolding, as described below. Overmolding does not break this connection. Plate 60 supports the cable clamp and the end of the cable 14 to prevent relative movement between the cable and the contact pads on circuit board 36 during overmolding.

After the cable clamp has been secured to the end of cable 14 as described, the cable clamp, end of the cable, circuit board 36, spacer plate 52, ground plate 60 and block 26 are placed in a suitable mold cavity for forming overmolded body 24. The rear portion of block 26 extends into a recess in the cavity. Mold pins extend into the cavity to engage the lower surface of circuit board 36 and the tops of mounting posts 58 on plate 52 to hold the board and plates in place in the cavity. Similar large mold pins extend into the cavity to engage the outer surfaces of the upper and lower clamp bars 72 and 76 at the cable clamp. These pins prevent movement of the cable clamp during overmolding. The cable 14 extends outwardly of the mold cavity. The mold pins cooperate to hold the clamp, board and plate in place during overmolding and to assure that the rapid flow of molten plastic into the cavity does not move or injure the members confined within the cavity.

With the members of connector 12 confined within the cavity as described, molten plastic is flowed into the mold cavity to form overmolded body 24. Plastic fills the cavity and flows into the space between the circuit board 36 and plate 52. Plug 50 prevents plastic from flowing into the cavities in block 26. Plastic flows around the mold pins. After molding, the pins are withdrawn forming clamp pin recesses 78 and 80 extending to board 36 and plate 52 and clamp pin recesses 82 and 84 to either side of the cable clamp.

During overmolding the molten plastic flows around the end of the cable and into the openings 86 between the clamp arms 74 at the ends of clamp bars 72 and 76 and the cable to tightly secure the end of the cable and the cable clamp in the overmolded body The cable clamp prevents plastic from flowing into the cable. As shown in FIGS. 2, 6 and 7, overmolded body 24 completely surrounds the end of the cable, the cable clamp 28, board 36 and the main body of plate 60, and the rear of block 26. Contact fingers 64 overlie the top of block 26.

The overmolded body 24 includes a pair of lock projections 88 located to either end of the block 26 and a distance rearwardly of the block 26. These projections cooperate with latches 92 on pin header receptacle 16 to secure the header receptacle and connector 12 in the mated position.

The shielded pin header 16 includes an elongate molded plastic body 90 with a pair of latch arms 92 pivotedly connected to opposite ends of the body. The body includes an elongate central recess 94 extending between the ends of the body defined by a top wall 96, a bottom wall 98, body ends 100, and a rear wall 102 which extends between the top and bottom walls and between the ends. Two spaced rows of pin contacts 104 extend through the rear wall 102 and into recess 94 in alignment for establishing electrical connection with the disconnect terminals 44 in block 26 when the ribbon cable connector and pin header receptacle are mated. The ends of the pin contacts outwardly of body 90 form contact tails 105 and are bent down at 90 degrees as shown in FIG. 2 for making soldered electrical connections with contacts in holes formed through circuit board 18. The body 90 is located on board 18 by a pair of posts 106 extending downwardly from ends 100 which are fitted into apertures formed in the board as shown in FIG. 2.

Figure 4:
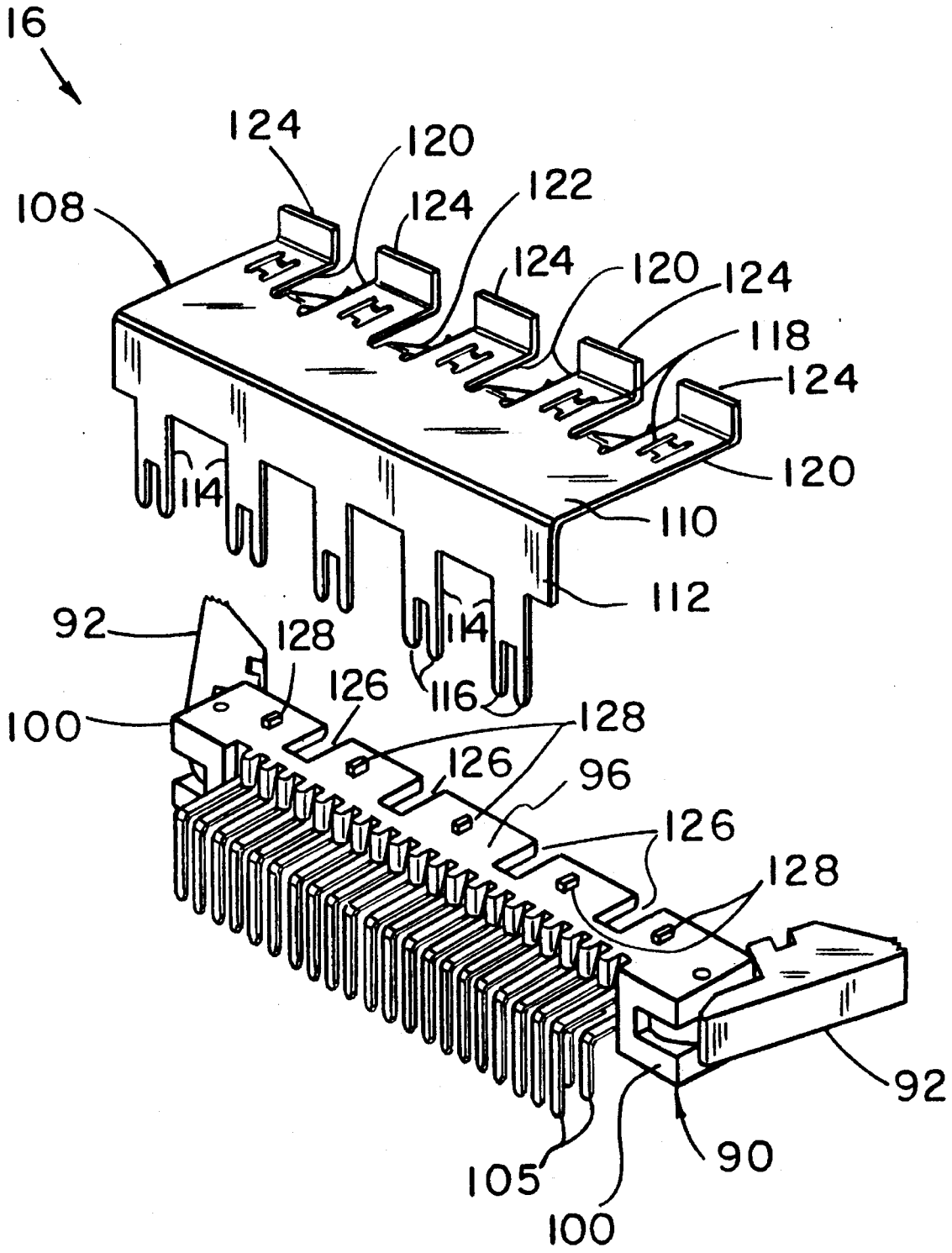
FIG. 4 is an exploded isometric view of the receptacle shown in FIG. 1.

A ground plate 108 shown in FIG. 4 is mounted on body 90 and overlies the top and rear body walls. Plates 60 and 108 are stamp formed from thin metal stock. As shown in FIG. 4, plate 108 includes a horizontal portion 110 extending the length of the body 90 and overlying the top of the body and the pin contact tails 105, and a vertical portion 112 overlying the rear wall and spaced a distance outwardly of the tails. A plurality of spaced arms 114 extend downwardly from wall 112 and each includes a pair of contact lugs 116 on the free end thereof. Apertures 118, like apertures 62 in plate 60, are formed in spaced extensions 120 of the horizontal portion 110. Downwardly bent contact arms 122 are joined to the horizontal portion 110 between the extensions 120 and extend below the surface of horizontal portion 110. The free ends of the extensions 120 are bent upwardly to form contact flanges 124.

A plurality of recesses 126 are formed in top wall 96 of body 90 and are spaced along the length of the wall. Mounting posts 128, like posts 58 of spacer plate 52, project upwardly from wall 96 in alignment with the apertures 118 of the ground plate 108. Ground plate 108 is mounted on body 90 by moving the plate onto the top of wall 96 with apertures 118 forced over the posts 128 so that the posts hold the plate in place on the body. The assembled pin header receptacle 16 is then positioned on circuit board 18 with posts 106 extending into the apertures in the board, the pin contact tails extending into signal solder holes in the board and lugs 116 of the plate extending into ground holes in the board. The logic ground conductors in cable 14 are connected through assembly 10 to at least one terminal tail which is soldered to a logic ground conductor in board 18. The tails and lugs are soldered to a circuit board using conventional soldering techniques.

The circuit board with mounted pin header receptacle is conventionally mounted in a shielded circuit assembly with the pin header receptacle adjacent to a wall of an assembly and recess 94 opening outwardly of assembly for receiving and mating with ribbon cable connector 12. As shown in FIG. 2, the contact flanges 124 of ground plate 108 abut a ground plane wall 130 to form a continuous ground connection between the wall, the plate 108, the mylar shield, plate 60 and the ground connection in circuit board 18.

The shielded ribbon cable connector 12 is mated with the pin header receptacle 16 by positioning the front face of block 26 adjacent recess 94 and then pushing the block 26 into recess 94 so that terminals 44 mate with the two rows of pin contacts 104 located within the recess. Polarizing ridges 132 are provided on the top face of block 26 and corresponding polarizing recesses (not illustrated) are formed in the top of recess 94 to assure proper orientation of the block 26 within recess 94. When the connector and pin header receptacle are fully assembled latch arms 92 are rotated inwardly to engage projections 88 and maintain the connector and header receptacle in the mated position as shown in FIG. 1.

Mating of the connector and pin header moves exposed contact fingers 64 on top of block 26 under the contact arms 122 of ground plate 108, flexes the contact arms upwardly and forms a plurality of reliable electrical connections between the two ground plates. In this way, the two plates form an effective frame ground shield for the contacts in the pin header receptacle and for the signal and logic ground conductors in the cable connector. The cable clamp forms a reliable electrical connection between plate 60 and the metallized surface on the interior of the mylar film 38 surrounding the cable thereby continuing the frame ground from circuit board 18 through the ground plates and to the ribbon cable 14.

The connection between connector 12 and pin header receptacle 16 is broken by outwardly rotating the latch arms 92 out of engagement with projections 88 and withdrawing the connector from the header receptacle.

During overmolding, the molten plastic forming the overmolded body 24 is flowed into the mold cavity, and completely surrounds the elements of connector 12 confined within the mold cavity. After overmolding, the clamp arms 74 and surrounding plastic hold the rigid channel bars 72 and 76 in tight clamp and strain relief position on the cable, thereby confining the U-bend in the cable in place and maintaining the ground connection. The convex surface of clamp bar 76 with the smaller radius channel fits in the inside of the U-bend and the concave surface of clamp bar 72 with the larger radius channel fits over the outside of the U-bend. As illustrated in FIG. 2, the radius of curvature of contact channel 68 is greater than that of clamp bar 76 and less than that of clamp bar 72.

While I have illustrated and described a preferred embodiment of my invention, it is understood that this is capable of modification, and I therefore do not wish to be limited to the precise details set forth, but desire to avail myself of such changes and alterations as fall within the scope of the following claims.

What I claim as my invention is:

1. A ribbon cable connector assembly comprising,

A) a ribbon cable having a plurality of conductors spaced across the width of the cable and a ground shield surrounding the cable; and B) a connector on an end of the ribbon cable, the connector including a first face, a row of contact terminals at the first face for forming electrical connections with a row of contact members, electrical connection circuit paths joining the conductors in the ribbon cable to the contact terminals, a cable clamp including a first clamp bar extending across the width of one side of the cable with a first surface engaging the cable and a second clamp bar extending across the width of the other side of the cable across from the first bar with a second surface engaging the cable, the ends of the clamp bars extending beyond the edges of the ribbon cable and clamp members joining the ends of the clamp bars outwardly of the edges of the cable so that a section of the cable is clamped between the first and second surfaces of the bars, a ground member including a first contact end proximate the first face for forming an electrical connection with a ground contact and a second contact end at the cable clamp, the second end extending between the clamp bars so that clamp bars hold the second end in electrical connection against the cable ground shield, and an overmolded plastic body surrounding the end of the cable, the cable clamp, the electrical connection circuit paths and the ground member.

2. An assembly as in claim 1 wherein the ends of the clamp members and the edges of the cable define openings, said overmolded body filling said openings.

3. An assembly as in claim 1 including mold pin recesses in the overmolded body extending from the exterior of the body to both of the clamp bars.

4. An assembly as in claim 1 wherein said clamp bars are metal and channel-shaped in transverse cross section, each clamp member comprises an arm on one bar folded over an end of the other bar and said concave surface has a radius of curvature greater than the radius of curvature of the convex surface.

5. An assembly as in claim 4 wherein the arms are on the ends of the clamp bar having the concave surface.

6. An assembly as in claim 1 wherein the ground member includes a shield plate overlying the electrical connection circuit paths and the second contact end of the ground member comprises a channel member located in the cable between the conductors and the ground shield, and including a spacer located within the overmolded body between the circuit paths and the shield plate.

7. An assembly as in claim 6 wherein said channel member extends substantially across the width of the ribbon cable.

8. An assembly as in claim 7 wherein the radius of curvature of the channel member is less than the radius of curvature of the concave surface and greater than the radius of curvature of the convex surface.

9. An assembly as in claim 1 including a plug located between the contact terminals and the overmolded body.

10. An assembly as in claim 9 wherein the plug engages the circuit paths.

11. An assembly as in claim 1 wherein the connector includes a circuit board embedded within the overmolded body and having a rear edge extending along the cable clamp and a front edge, said circuit paths extending along the circuit board between said edges, first electrical connections joining the conductors in the cable to contact pads on the board at the rear edge, a connector block molded to the overmolded body and defining said first face, said contact terminals being located within said block and including contact terminal tails extending into the overmolded body, second electrical connections joining the terminal tails to contact pads at the front edge of the circuit board, said ground member comprising a first plate overlying the circuit board, and a spacer between the circuit board and the plate, said overmolded body surrounding said circuit board, spacer and plate.

12. An assembly as in claim 11 including a header having a mounting member adapted to mount the header on a second circuit board, a plurality of header terminals arranged to engage the contact terminals of the connector when the connector and header are mated, header terminal tails extending outwardly from such terminals for engaging circuitry on the second circuit board and a second ground plate overlying said header terminal tails, said second plate including a contact member engagable with said first contact end when said connector and header are mated and a contact lug adapted to form an electrical connection with ground circuitry on the second board whereby said first and second ground plates form an electrical connection between ground circuity in the second circuit board and the cable shield.

13. An assembly as in claim 12 including a first mounting member for securing the first ground plate to the spacer and a second mounting member for securing the second ground plate to the header.

14. An assembly as in claim 12 wherein said second ground plate includes a contact flange adjacent the first face adapted to form a ground connection with a wall member.

15. An assembly as in claim 11 wherein the spacer includes a spacer ridge on one side of the spacer, said ridge adapted to be seated on the circuit board between the front and rear edges.

16. An assembly as in claim 15 wherein the circuit board, spacer and ridge define spaces, said overmolded body filling said spaces.

17. An assembly as in claim 11 wherein the spacer includes a first spacer edge and a beveled surface on the edge, said surface adapted to engage the contact terminal tails.

18. An assembly as in claim 11 wherein the ground member has first and second side edges and side arms on the edges, said arms adapted to engage the circuit board.

19. An assembly as in claim 13 including first molding recesses extending between the first mounting member and the exterior of the overmolded body and second molding recesses extending between the circuit board and the exterior of said body.

20. A shielded electrical connector assembly comprising,

A) a ribbon cable having a plurality of electrical conductors spaced along the width of the cable and a grounding shield surrounding the cable;

B) a connector having first and second spaced faces and including a cable clamp surrounding one end of the cable, the cable clamp including two opposed clamp bars with one bar having a concave surface engaging one side of the ribbon cable and the other bar including a convex surface overlying the concave surface and engaging the other side of the ribbon cable and connections joining the ends of the bars together outwardly of the cable to clamp the cable between the bars, said connector including a connector block at said first connector face, said block defining at least one row of cavities extending along the block and opening through said first face, disconnect terminals located in said cavities, each terminal including a terminal tail extending out of the cavity, a first circuit board having a first edge adjacent the connector block and a second edge adjacent the cable clamp, circuitry on said board extending between said edges and including contact pads at said edges, the tails of said terminals in said connector block being connected to pads at said first board edge, the conductors in said cable being connected to contact pads at said second board edge, a spacer overlying the circuit board, a connector ground plate on a side of the spacer away from the circuit board and including a contact tongue extending into the cable clamp between the clamp bars and in engagement with the grounding shield surrounding the cable conductors and a contact member located adjacent the disconnect terminals in the connector block, and an overmolded plastic body surrounding the end of the cable, the cable clamp, the circuit board, the spacer, the ground plate and said connector block away from said front face; and C) a contact header adapted to be mounted on a second circuit board, the header including a body, at least one row of header terminals extending from said body for electrical engagement with said disconnect terminals in said connector block when the connector and header are mated, terminal tails extending outwardly from the header terminals including ends adapted to form electrical connections with contact pads on the second circuit board and a header ground plate overlying said header terminals and terminal tails and including a contact adapted to engage ground circuitry in the second circuit board and a contact element adapted to engage said contact member when the header and connector are mated to thereby form a ground electrical connection extending from ground circuitry in the second circuit board through the header ground plate, the connector ground plate to the cable shield.

21. An assembly as in claim 20 including a plug located between the connector block and the overmolded body.

22. An assembly as in claim 21 wherein said clamp bars are formed from channel-shaped metal members and an radius of curvature of an concave surface is greater than the radius of curvature of the convex surface.

23. An assembly as in claim 22 wherein each connection comprises an arm extending away from an end of one clamp bar folded over an end of the other clamp bar.

24. An assembly as in claim 23 wherein said spacer comprises a plate located between the circuit board and the connector ground plate and including mold clamp pin recesses in the overmolded body on either side of the mold clamp and to either side of the circuit board and ground plate.

25. The method of making a shielded ribbon cable connector comprising the steps of:

A) providing a connector block having a first face, at least one row of cavities extending along the first face, and a disconnect terminal in each cavity with a terminal tail extending outwardly of the block away from the first face;

B) providing a ribbon cable having a plurality of conductors and a ground shield surrounding the conductors;

C) attaching a cable clamp to an end portion of the cable by positioning a first clamp bar with a concave surface against one side of a cable and a second clamp bar having a convex surface against the opposite side of the cable and moving the bars together to bend the cable between the bars to a U-shape;

D) attaching conductors at the end of the cable to contact pads extending along one edge of a circuit board and attaching the terminal tails to contact pads extending along an opposite edge of the circuit board to form electrical connections joining the conductors and the terminals;

E) positioning a ground shield having a tongue at one end and a contact finger at the opposite end on a spacer and positioning the spacer on one side of the circuit board with the shield away from the circuit board, the tongue extending between the clamp bars and in contact with the ground shield and the contact finger overlying the connector block; and F) forming an overmolded plastic body surrounding the end of the cable, the cable clamp, the circuit board, the spacer and the ground plate and a part of the connector block away from the first face.

26. The method of claim 25 including the step of plugging the ends of the cavities in the connector block away from the front face before performing step F).

27. The method of claim 25 including the steps of holding the ends of the clamp bars together while performing step B) and engaging opposite sides of the clamp bars between mold pins while performing step F).

28. The method of claim 27 including the step of holding the circuit board and ground shield between mold pins while performing step F).

29. The method of claim 25 including the step of positioning the grounding shield tongue within the cable between the conductors and the ground shield.

30. The method of claim 25 including the step of securing together the first and second clamp bars before performing step D) by bending arms on the ends of the first clamp bar over the ends of the second clamp bar and onto the other clamp bar.

31. An assembly as in claim 1 wherein the first surface is concave, the second surface is convex, and the section of the cable is U-shaped.

* * * * *